US006396008B1

(12) United States Patent
Maloney et al.

(10) Patent No.: US 6,396,008 B1
(45) Date of Patent: May 28, 2002

(54) HANDLE LOCK DEVICE AND ELECTRICAL SWITCHING APPARATUS EMPLOYING THE SAME

(75) Inventors: James Gerard Maloney, Industry; Joseph Frank Changle, Carnegie, both of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/780,019

(22) Filed: Feb. 8, 2001

(51) Int. Cl.[7] ..... H01H 9/28

(52) U.S. Cl. ..... 200/43.14; 200/43.15; 70/203

(58) Field of Search ..... 70/180, 202, 203, 70/212; 200/43.11, 43.13, 43.14, 43.16, 43.19, 43.21, 43.22, 43.15

(56) References Cited

U.S. PATENT DOCUMENTS

| | | | | |
|---|---|---|---|---|
| 4,260,861 A | | 4/1981 | DiMarco | 200/42 T |
| 4,554,421 A | | 11/1985 | Grunert et al. | 200/43.15 |
| 4,760,220 A | | 7/1988 | Fritsch et al. | 200/50 A |
| 4,882,456 A | | 11/1989 | Hovanic et al. | 200/43.15 |
| 5,165,528 A | | 11/1992 | Kozlowski et al. | 200/43.15 |
| 5,181,602 A | | 1/1993 | Kozlowski et al. | 200/43.15 |
| 5,467,622 A | | 11/1995 | Becker et al. | 70/203 |
| 5,500,495 A | * | 3/1996 | Benda et al. | 200/43.14 |
| 5,775,481 A | | 7/1998 | Lyke | 200/43.22 |
| 5,817,998 A | | 10/1998 | Siebels et al. | 200/43.14 |
| 5,817,999 A | | 10/1998 | Mugan et al. | 200/50.11 |
| 5,821,487 A | | 10/1998 | Groves et al. | 200/50.02 |
| 5,905,236 A | | 5/1999 | Green | 200/43.14 |
| 6,015,956 A | | 1/2000 | Green | 200/43.14 |

OTHER PUBLICATIONS

©2000 Hoffman Enclosures Inc., Bulletin A80, General Accessories, "*Safety Lockouts*", pp. 11.11, 2000.

* cited by examiner

*Primary Examiner*—Michael Friedhofer
(74) *Attorney, Agent, or Firm*—Martin J. Moran

(57) ABSTRACT

A circuit breaker includes a housing; separable contacts; an operating mechanism having a movable operator handle with an OFF position and an ON position; and a handle lock device. The handle lock device includes: a member secured to the housing, a flange on the member disposed alongside the operator handle, an opening in the flange adapted to receive only one shackle and having a perimeter which includes first opposing portions adapted to receive a cross section of a safety lockout shackle and to restrain rotation of the shackle within the opening. The shackle blocks movement of the operator handle from the OFF to the ON position thereof. The perimeter also includes second opposing portions adapted to alternatively receive the different cross section of a shackle of a padlock with that shackle blocking movement of the operator handle from the OFF to the ON position thereof.

24 Claims, 6 Drawing Sheets

HANDLE LOCK DEVICE AND ELECTRICAL SWITCHING APPARATUS EMPLOYING THE SAME

BACKGROUND OF THE INVENTION

1. Field of the Invention

This invention relates to a handle lock for a handle operated electrical switching apparatus and, more particularly, to such a handle lock for locking a movable handle in the OFF position of the apparatus. The invention also relates to an electrical switching apparatus, such as a circuit breaker, including a handle lock.

2. Background Information

Electrical switching apparatus include, for example, circuit switching devices and circuit interrupters such as circuit breakers, contactors, motor starters, motor controllers and other load controllers.

Circuit breakers are generally old and well known in the art. Circuit breakers are used to protect electrical circuitry from damage due to an overcurrent condition, such as an overload condition or a relatively high-level short circuit condition.

Circuit breakers used in residential and light commercial applications are commonly referred to as miniature circuit breakers because of their limited size. Such circuit breakers typically have a pair of separable contacts opened and closed by a spring biased operating mechanism. A thermal-magnetic trip device actuates the operating mechanism to open the separable contacts in response to persistent overcurrent conditions and to short circuits. Usually, circuit breakers of this type for multiple circuits within the residence or commercial structure are mounted together within a load center or panelboard, which may be located in a basement or other remote location.

Some electrical switching apparatus, such as circuit breakers, have padlock hasps associated with the operator handle whereby a padlock may be attached through the hasp in a position to block movement of the operator handle from one operating position to an opposite operating position. Thus, a worker working on equipment in a line controlled by the apparatus can disconnect electrical power from the line and be assured that it will not be reconnected until the padlock is removed from the apparatus. The hasps of the apparatus generally accept one or more padlocks having shackles to allow individual workers to apply their respective padlocks.

A device popular with workers is a safety lockout, which may be attached to the hasp of the apparatus. The safety lockout has provisions to receive up to six padlocks. The safety lockout is a scissors-like device made from a pair of flat hardened steel plates, hinged at approximately the center, to provide a pair of openable jaws, which close and overlap through the hasp. Handle portions of each plate have six holes, which respectively align when the device is closed so that the jaws overlap. Shackles of padlocks may be inserted through any of the aligned six holes to prevent opening of the safety lockout and removal thereof from the apparatus. A problem with the safety lockout is that the flat, two-piece shackle is narrower and thinner than the padlock shackle. When used in a hasp that can accommodate a plurality of padlock shackles, the safety lockout shackle can be moved and twisted to a position wherein it is ineffective to block the movement of the operator handle.

U.S. Pat. No. 5,467,622 discloses a molded case circuit breaker having an auxiliary operator mechanism attached thereto. A security hasp is provided for the handle operator by providing an upstanding flange having an opening, which is sized and shaped to receive up to three padlock shackles simultaneously. Locking the padlock to the hasp by inserting the padlock shackle through the flange opening secures the padlock in a position interfering with movement of the operator handle, thereby blocking movement of the handle from one operating position to an opposite operating position. An auxiliary plate is pivotally mounted to the flange. The plate may be stored in an adjacent position, to one side of the flange opening. When it is desired to use a safety lockout or a padlock, the plate is pivoted wherein the plate covers the opening in the flange. The plate has a round hole for a single padlock which aligns near a top edge of the flange opening and near an edge of such opening that is closest to the operator handle in the OFF position. The plate also has an elongated opening that is similarly aligned with the flange opening, and overlaps the edge of such opening closest to the operator handle. The elongated opening receives the thin flat cross-section portion of a shackle of a safety lockout and maintains that shackle properly oriented to block movement of the operator handle to the opposite operated position.

U.S. Pat. No. 5,817,999 discloses a circuit breaker operating handle locking device which selectively keeps the circuit breaker operating handle locked and prevented from moving between OFF and ON positions. A locking arm selectively engages the circuit breaker operating handle in either of the OFF and ON positions. A locking bracket passes through a narrowed locking section of the locking arm and past a lock-receiving hole in the bracket. The lock-receiving hole has an asymmetric portion for receiving a safety lockout device, such as the one available from Hoffman Engineering Company of Anoka, Minn. as Catalog Number A-SL6. This allows the locking device to accommodate a number of security locks or a security lock having a hasp, which is larger than the lock-receiving hole. The security lock prevents pivotal movement of the locking arm. Longitudinal movement of the locking arm is prevented by the circuit breaker operating handle wedging the locking arm against one end of a cut-away groove. The asymmetric portion of the lock-receiving hole is positioned away from the mounting plate so that when a gangling arrangement is positioned on the device it does not obstruct the mechanism.

It is known to employ a handle lockoff bracket including a plate secured on the front face of a circuit breaker. Disposed on the plate is a flange, which has a D-shaped opening that accepts the shackles of one or more padlocks, in order to maintain the handle of the circuit breaker in its OFF position.

There is room for improvement in handle lock devices and in circuit breakers employing the same.

SUMMARY OF THE INVENTION

This need and others are satisfied by the invention, which is directed to a handle lock device that functions with ganged (e.g., handle-tied) multiple pole circuit breakers as well as single pole circuit breakers. The handle lock device accepts either a padlock or a scissor lock.

As one aspect of the invention, a handle lock device for a movable operator handle of an electrical switching apparatus is operable with a shackle of a safety lockout device and alternatively operable with a shackle of a padlock. The handle lock device comprises: a member adapted for securement to the electrical switching apparatus; a flange on the member adapted for positioning alongside the movable operator handle of the electrical switching apparatus; and an opening in the flange, the opening adapted to receive only one shackle and having a perimeter which includes first opposing portions adapted to receive the first cross section of the shackle of the safety lockout device and to restrain rotation of the first cross section within the opening, with the shackle of the safety lockout device blocking movement of the movable operator handle from a first position to a second position thereof, the perimeter also includes second opposing portions adapted to alternatively receive a different second cross section of the shackle of the padlock with the shackle of the padlock blocking movement of the movable operator handle from the first position to the second position thereof.

The safety lockout device may be a scissor lock including locking members having the first cross section, which is a rectangular cross section having two opposing ends, and the first opposing portions of the perimeter of the opening may be adapted to restrain the ends of the rectangular cross section. The different second cross section of the shackle of the padlock may be a circular cross section, and the second opposing portions of the perimeter of the opening may be adapted to alternatively receive the circular cross section.

The first cross section may be a generally rectangular cross section, and the different second cross section may be a circular cross section. The perimeter of the opening may be defined by a first semi-circular portion proximate the movable operator handle, a first U-shaped portion, a second semi-circular portion, which is larger than the first semi-circular portion, and a second U-shaped portion, with the first U-shaped portion opposite the second U-shaped portion, and the first semi-circular portion opposite the second larger semi-circular portion. The first and second U-shaped portions may restrain the generally rectangular cross section, and the first and second semi-circular portions may receive the circular cross section.

As another preferred practice, the first and second U-shaped portions may restrain the generally rectangular cross section with a surface of the shackle of the safety lockout device in a plane blocking movement of the movable operator handle from the first position to the second position thereof. The first and second semi-circular portions may alternatively receive the circular cross section with an edge of a shackle of the padlock offset from such plane toward the movable operator handle and blocking movement of the movable operator handle from the first position to the second position thereof. The offset may be defined by the first semi-circular portion proximate the movable operator handle.

As another aspect of the invention, an electrical switching apparatus is operable with a shackle of a safety lockout device and alternatively operable with a shackle of a padlock. The electrical switching apparatus comprises: a housing; separable contacts; an operating mechanism having a movable operator handle to open and close the separable contacts, the movable operator handle having a first position and a second position; and a handle lock device comprising: a member secured to the housing, a flange on the member disposed alongside the movable operator handle of the operating mechanism, an opening in the flange adapted to receive only one shackle and having a perimeter which includes first opposing portions adapted to receive the first cross section of the shackle of the safety lockout device and to restrain rotation of the first cross section within the opening, with the shackle of the safety lockout device blocking movement of the movable operator handle from the first position to the second position thereof, the perimeter also includes second opposing portions adapted to alternatively receive a second cross section of the shackle of the padlock with the shackle of the padlock blocking movement of the movable operator handle from the first position to the second position thereof.

Preferably, the different second cross section of the shackle of the padlock is a circular cross section, and the perimeter of the opening has a generally circular portion, which is adapted to receive the circular cross section.

According to a preferred practice, the movable operator handle has an end which extends beyond a surface of the housing by a first distance, and the flange of the handle lock device extends beyond the surface of the housing by a second distance which is smaller than the first distance.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a miniature circuit breaker, although it will become apparent that it could be applied to other types of circuit breakers as well.

Figure 1:
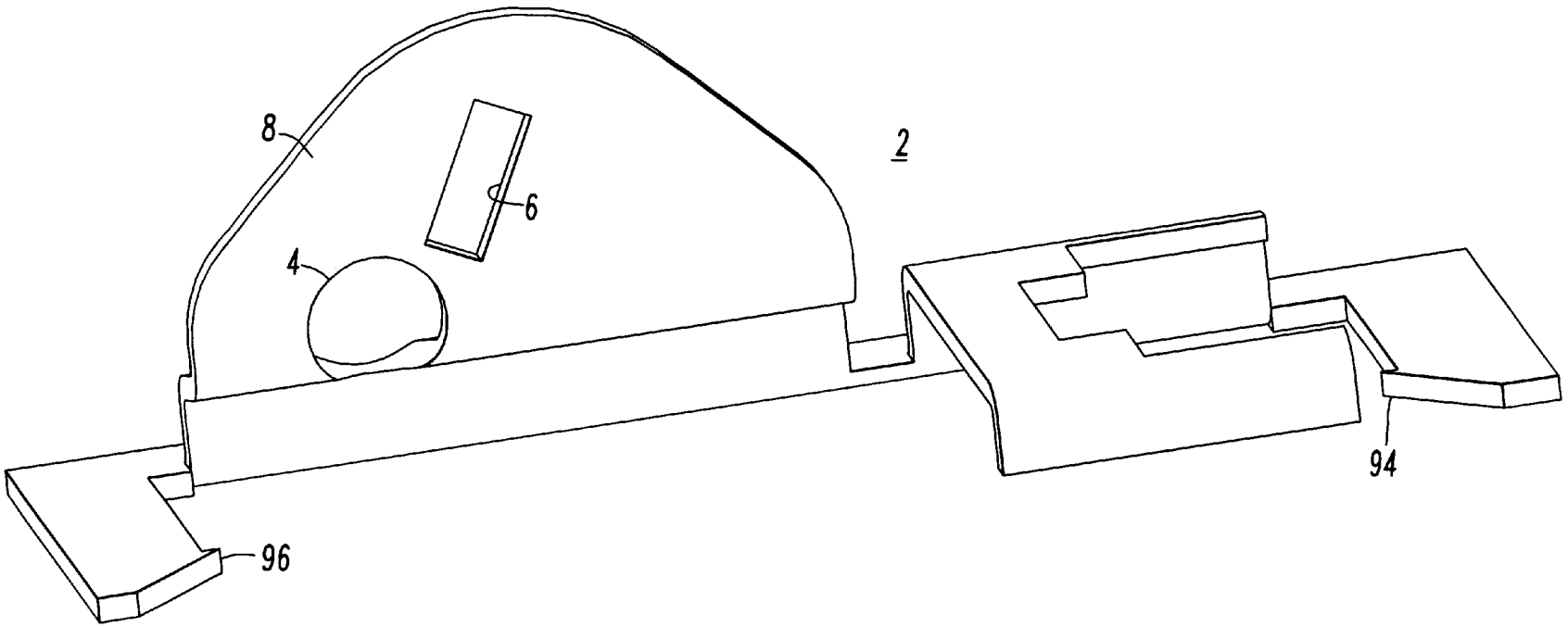
FIG. 1 is an isometric view of a handle lock device having a first opening for a padlock and a second opening for a scissor lock.
Figure 2:
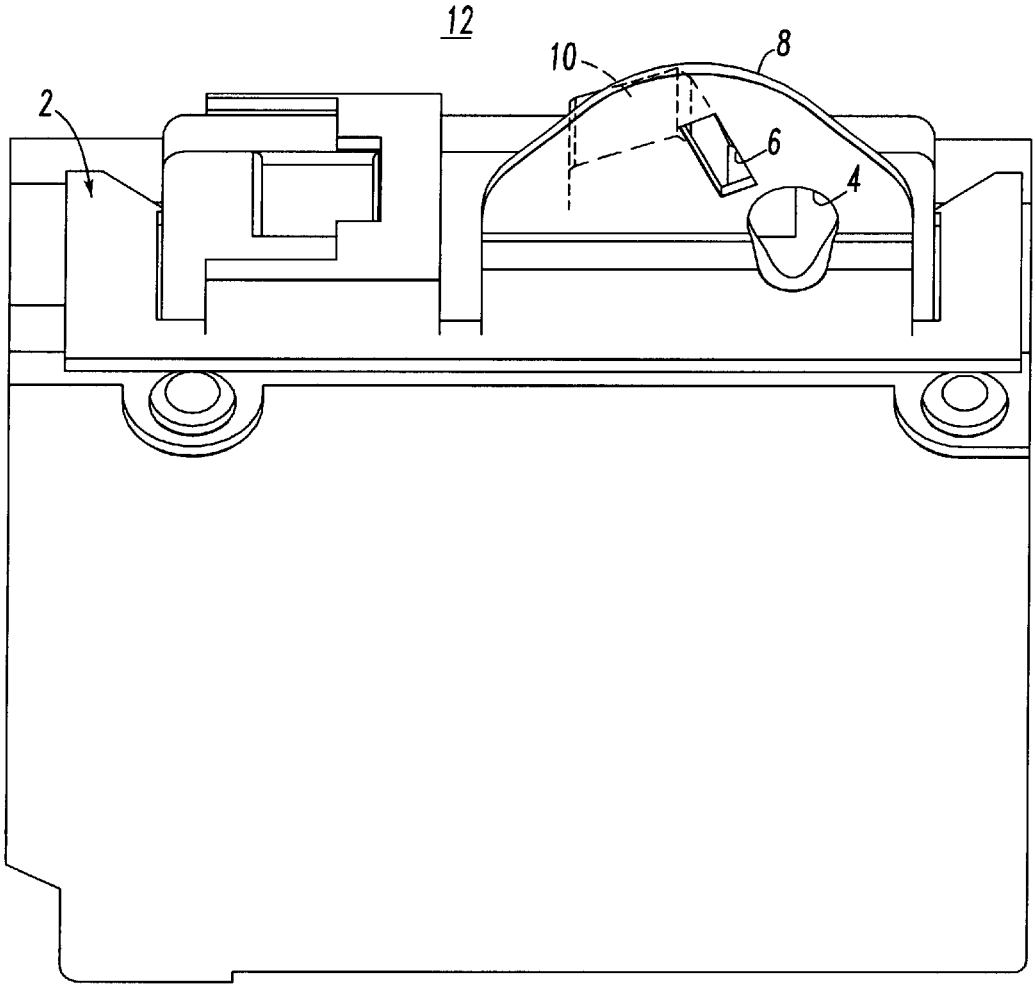
FIG. 2 is an isometric view of the handle lock device of FIG. 1 engaging a single pole circuit breaker.

FIGS. 1 and 2 show a handle lock device 2 having a first opening 4 for the shackle of a padlock (not shown) and a second opening 6 for the shackle of a scissor lock (not shown). In the exemplary handle lock device 2, the openings 4,6 extend through a flange 8, which extends above the handle 10 of the circuit breaker 12 as shown in FIG. 2. The flange 8 is, therefore, prone to interfere with the inside surface of a door to a panelboard or load center (not shown).

Figure 3:
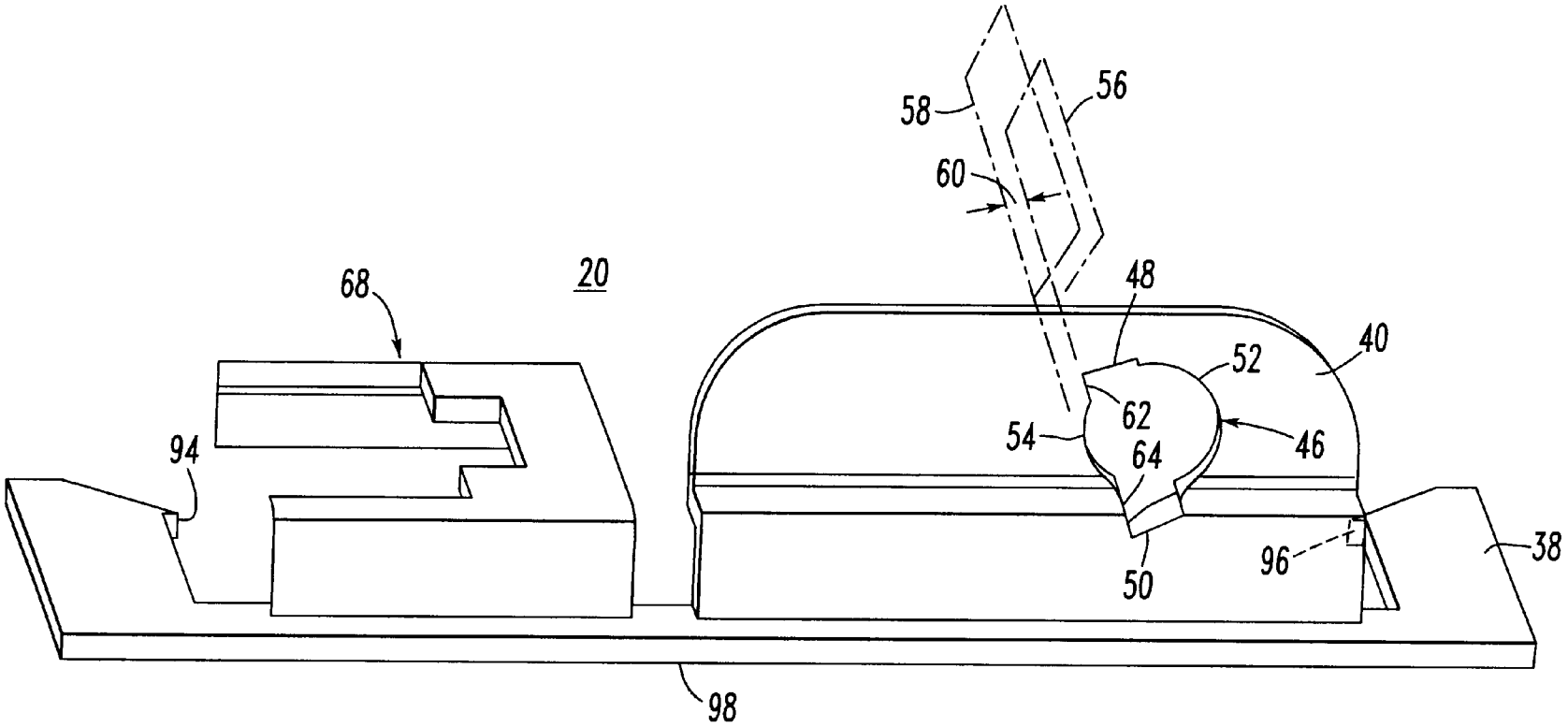
FIG. 3 is an isometric view of a handle lock device in accordance with the present invention having a single opening for a padlock or, alternatively, a scissor lock.
Figure 4:
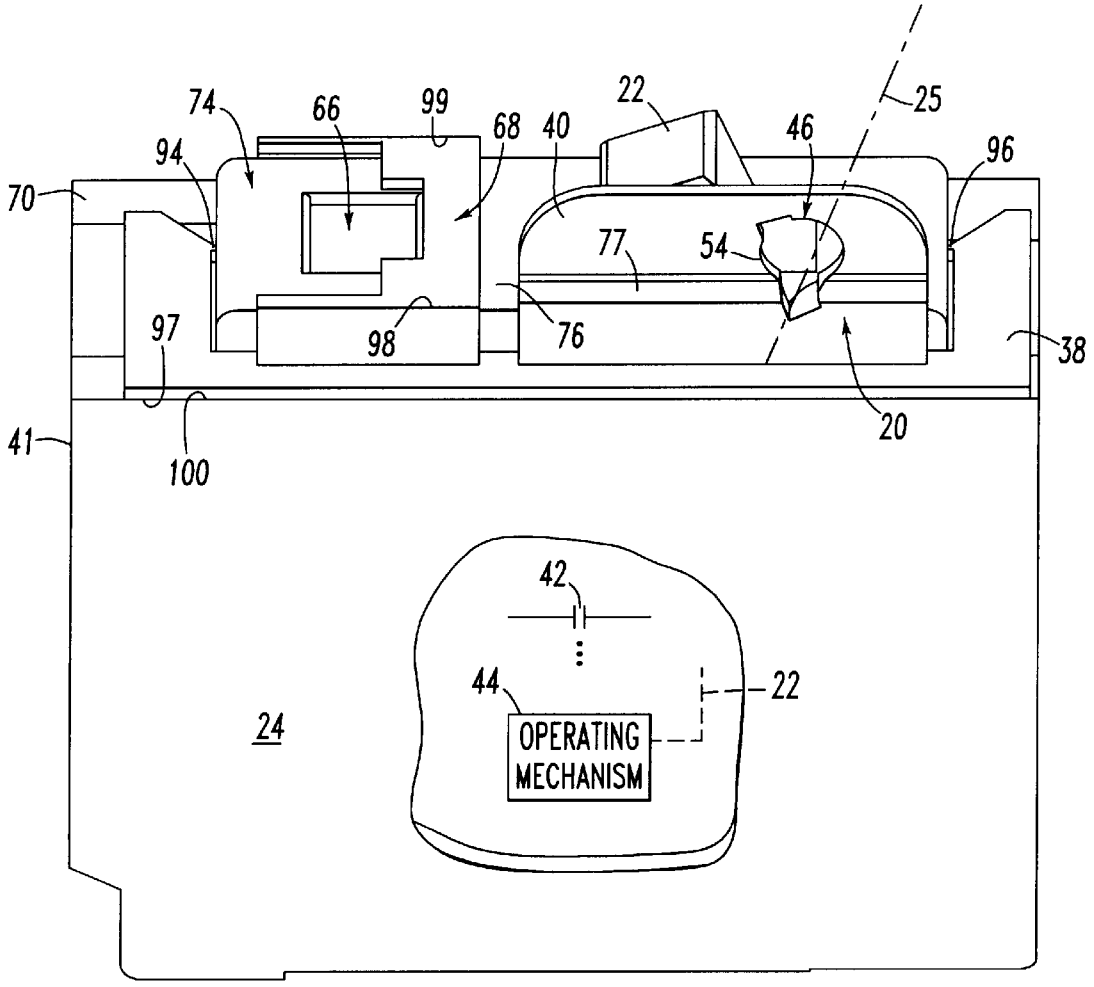
FIG. 4 is an isometric view of the handle lock device of FIG. 3 engaging a single pole circuit breaker.

FIGS. 3 and 4 show a handle lock device 20 in accordance with the present invention. As shown in FIG. 4, the handle lock device 20 is employed with the movable operator handle 22 of an electrical switching apparatus, such as the exemplary single pole circuit breaker 24. The movable operator handle 22 has a first OFF position (as shown in FIG. 4) and rotates to a second ON position (which is approximately shown by the line 25), although the invention is applicable to circuit breakers having additional handle positions, such as, for example, a trip position intermediate the exemplary OFF and ON positions. Although the exemplary handle lock device 20 is described in terms of blocking movement of the circuit breaker handle 22 from the OFF to the ON position thereof, the invention is applicable to other electrical switching apparatus in which such handle lock device blocks movement of a handle from the ON to the OFF or tripped positions thereof.

Figure 5:
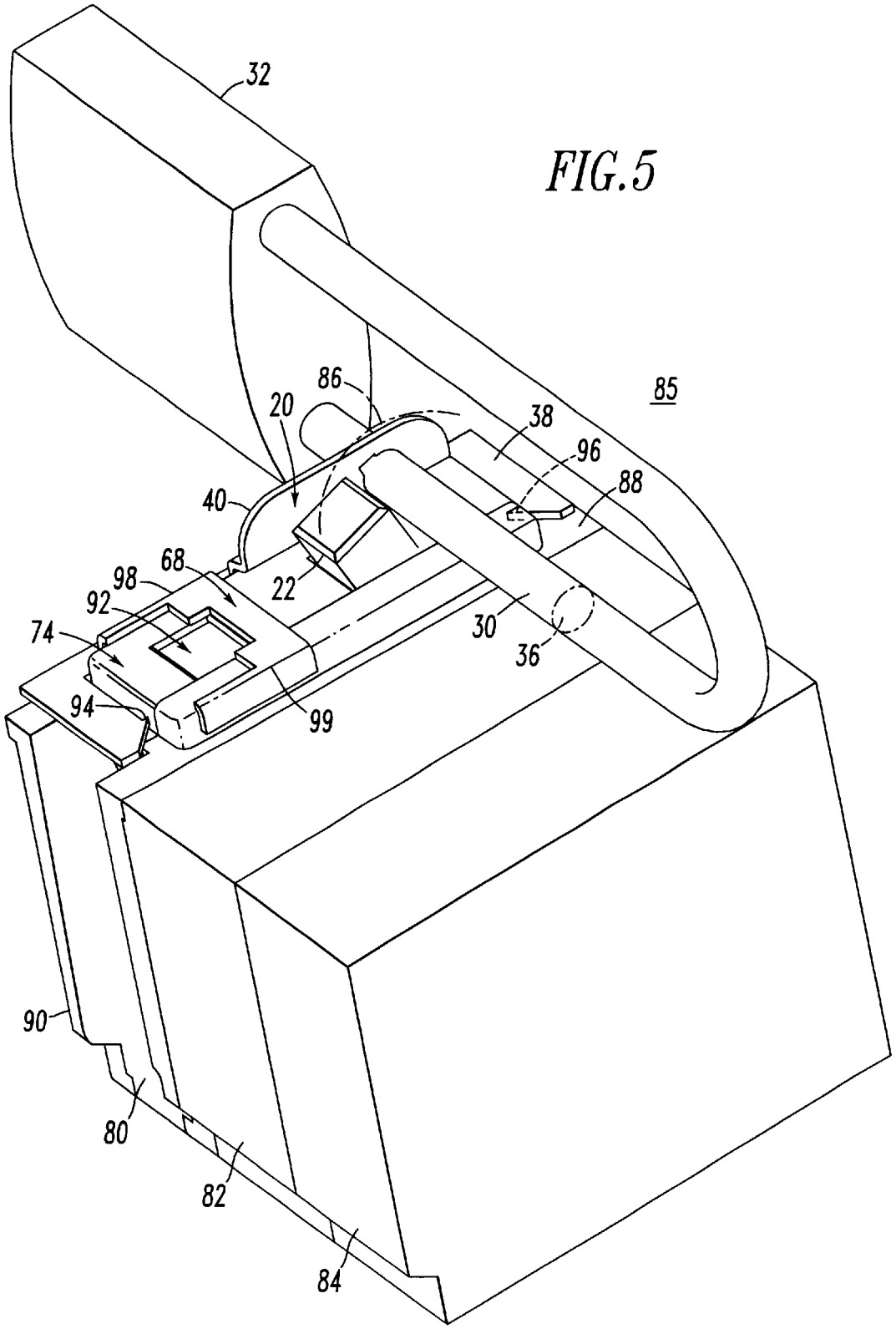
FIG. 5 is an isometric view of the handle lock device of FIG. 3 engaging one of a plurality of ganged single pole circuit breakers and employed a padlock.

The handle lock device 20 is operable with a shackle 26 of a safety lockout device, such as the exemplary scissor lock device 28 (FIG. 6), and is alternatively operable with a shackle 30 of a padlock 32 (FIG. 5). The scissor lock shackle 26 has a first cross section 34, which is a generally rectangular cross section (best shown in FIG. 8; shown in hidden line drawing in FIG. 6), and the padlock shackle 30 has a different second cross section 36, which is generally a circular cross section (e.g., having a 0.25 inch diameter) (shown in hidden line drawing in FIG. 5).

Still referring to FIGS. 3 and 4, the handle lock device 20 includes a member 38 adapted for securement to the circuit breaker 24, and a flange 40 on the member 38 adapted for positioning alongside the circuit breaker handle 22. As shown in FIG. 4, the exemplary circuit breaker 24 also includes a housing 41, separable contacts 42, and an operating mechanism 44 having the movable operator handle 22 to open and close the separable contacts 42, as is well known.

Figure 6:
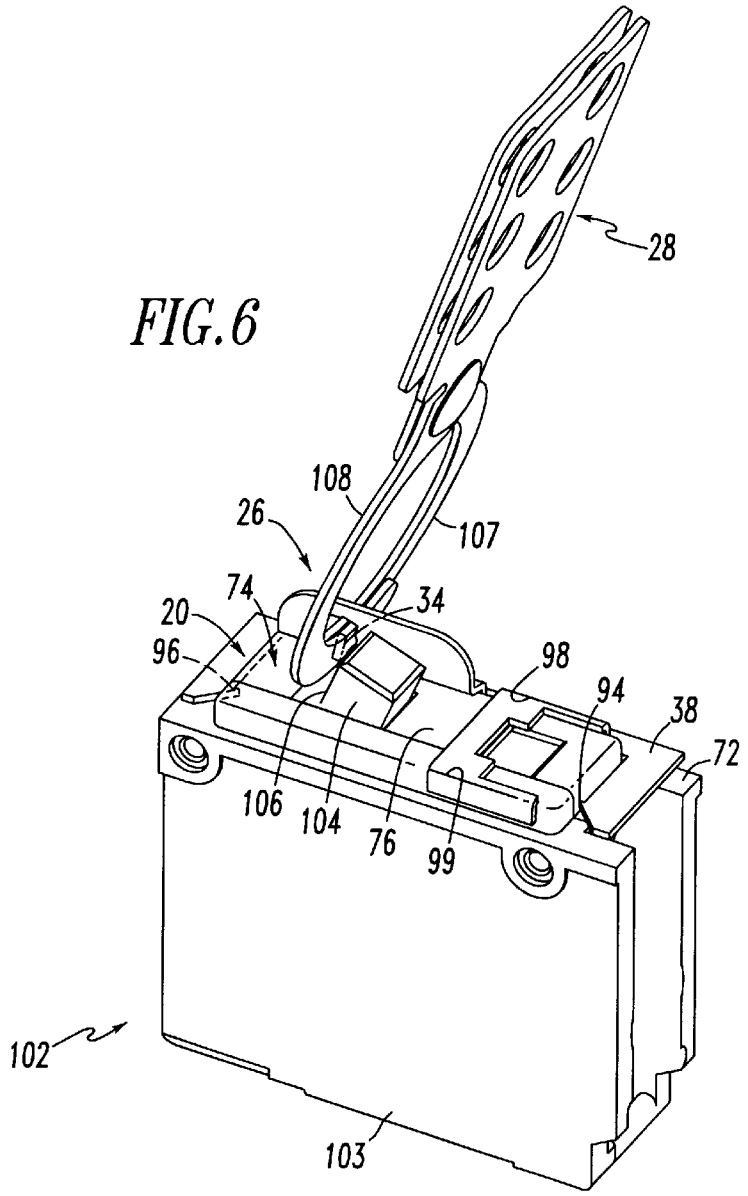
FIG. 6 is an isometric view of the handle lock device of FIG. 3 engaging a single pole circuit breaker and employing a scissor lock.

The member 38 is suitably secured to an upper portion (with respect to FIG. 4) of the housing 41. The flange 40 on the member 38 is disposed alongside the movable operator handle 22. In accordance with the present invention, an opening 46 in the flange 40 is adapted to receive only one shackle. The opening 46 has a perimeter which includes first opposing portions 48,50 adapted to receive the first cross section 34 of the safety lockout shackle 26 of FIG. 6, and to restrain rotation of that cross section 34 within the opening 46. As shown in FIG. 6, the safety lockout shackle 26 blocks movement of the movable operator handle 22 from the OFF position to the ON position thereof. The perimeter of the opening 46 also includes second opposing portions 52,54 adapted to alternatively receive the different second cross section 36 of the padlock shackle 30 of FIG. 5, with that shackle blocking movement of the movable operator handle 22 from the OFF position to the ON position thereof.

As best shown in FIG. 3, the perimeter of the opening 46 is defined by the first semi-circular portion 54 proximate the movable operator handle 22 (FIG. 4), the first rectangular U-shaped portion 48, the second semi-circular portion 52, which is larger than the first semi-circular portion 54, and the second rectangular U-shaped portion 50, with the first rectangular U-shaped portion 48 being opposite the second rectangular U-shaped portion 50, and the first semi-circular portion 54 being opposite the second larger semi-circular portion 52. The semi-circular portions 52,54 define a generally circular portion, which is adapted to receive the circular cross section 36 of the padlock shackle 30 of FIG. 5.

The opposing rectangular U-shaped portions 48,50 are adapted to receive the generally rectangular cross section 34 of the safety lockout shackle 26 of FIG. 6, and to restrain rotation of that cross section 34 within the opening 46. The opposing semi-circular portions 52,54 are alternatively adapted to receive the circular cross section 36 of the padlock shackle 30 of FIG. 5. The opposing rectangular U-shaped portions 48,50 restrain the generally rectangular cross section 34 with a surface of that shackle 26 in a plane 56 (shown in FIG. 3) suitable for blocking movement of the movable operator handle 22 from the OFF to the ON position thereof. The edge of the padlock shackle 30 adjacent the operator handle 22 of FIG. 5 is offset from the plane 56 toward the operator handle 22 (as shown by the plane 58 of FIG. 3), and blocks movement of that handle from the OFF to the ON position thereof. Preferably, the edge of the padlock shackle 30 engages the operator handle 22 in the ON position thereof. As best shown in FIG. 3, the offset 60 is defined by the first semi-circular portion 54 proximate the operator handle 22 and by legs 62,64 of the respective opposing rectangular U-shaped portions 48,50.

As shown in FIG. 4, the exemplary housing 41 includes a window portion 66, and the member 38 of the handle lock device 20 includes a cut out portion 68 proximate the window portion 66. The cut out portion 68 of the device 20 is employed in connection with the window portion 66 above a portion of the upper face 70 (with respect to FIG. 4) of the circuit breaker 24, which portion is employed for placement of labels (not shown) thereon. The face 70 has a surface 72 (as best shown in FIG. 6), and a raised portion 74 with a surface 76 thereon. The flange 40 of the handle lock device 20 includes a surface having an L-shaped portion 77, which abuts the raised portion 74 and its surface 76.

FIG. 5 shows the handle lock device 20 of FIG. 3 engaging a first circuit breaker 80 of a set of three ganged single pole circuit breakers 80,82,84, thereby providing a three-pole circuit breaker 85, although the invention is applicable to circuit breakers having one, two, three, four or more poles. Since the circuit breakers 80,82,84 are ganged, the operating handle 22 of the first circuit breaker 80 moves with the operating handles (not shown) of the other circuit breakers 82,84, and the padlock shackle 30 blocks at least one of the handles (as shown with the handle 22 of the first circuit breaker 80) and, thus, effectively blocks the handles of the other circuit breakers 82,84.

In accordance with a preferred practice of the present invention, the movable operator handle 22 has an end, which extends by a distance (as defined by the operating arc 86) beyond the upper (with respect to FIG. 5) surface 88 of the circuit breaker housing 90. The flange 40 of the handle lock device 20 extends beyond the surface 88 by a smaller distance (which is best seen beneath the crest of the arc 86). In this manner, when the padlock 32 is removed, the flange 40 does not extend above the crest of the arc 86 and, therefore, the device 20 may advantageously be employed without interfering with an inside surface of the door (not shown) to an electrical distribution panel, such as a load center, panelboard, or other indoor or outdoor panel for distributing electrical power to one or more loads.

As shown in FIG. 5, the exemplary housing 90 includes a test button 92, such as a ground fault test button, with the member 38 of the handle lock device 20 including the cut out portion 68 proximate the test button 66, in order to provide access thereto.

As shown in FIG. 3, the device 20 has a pair of teeth 94 and 96 (shown in hidden line drawing), for securement to the housing 41 of the circuit breaker 24 of FIG. 4, or to the housing 90 of the circuit breaker 80 of FIG. 5. The member 38 of the device 20 has a lower surface 97 (with respect to FIG. 4), which abuts the upper surface 100 (with respect to FIG. 4) of the face 70 of the housing 41. The teeth 94 and 96 (as best shown in FIGS. 4 and 6, respectively) engage the exemplary raised portion 74 of the housing 41. The cut out portion 68 includes two L-shaped portions 98,99, which similar to the L-shaped portion 77, abut the raised portion 74 and its surface 76. The teeth 94,96 and the L-shaped portions 77,98,99 secure the device 20 to the circuit breaker 24 at the line (at the right side of FIG. 4) and load (at the left side of FIG. 4) ends thereof.

As shown in FIG. 5, the exemplary device 20 preferably provides a suitable width (e.g., about 1 inch), in order to accommodate one or more adjacent ganged (e.g., 1, 2 or 3 additional circuit breakers, such as 82,84, thereby also providing 2, 3 or 4-pole operation). In this example, the device is secured to the left most (with respect to FIG. 5) pole of the exemplary three-pole circuit breaker 85.

FIG. 6 shows the exemplary handle lock device 20 of FIG. 3 engaging a single pole circuit breaker 102 as employed with the scissor lock 28. The circuit breaker 102 includes a housing 103 and a movable operator handle 104 (shown in the OFF position). The handle 104 has a surface 106, which is disposed at an angle with respect to the member 38 of the device 20. The opposing rectangular U-shaped portions 48,50 of the opening 46 of FIG. 3 are also disposed at the same angle with respect to the member 38, in order that the shackle 26 of the scissor lock 28 is disposed at the same angle, thereby blocking counter-clockwise (with respect to FIG. 6) movement of the operator handle 104 from the OFF position to the ON position (not shown).

Figure 7:
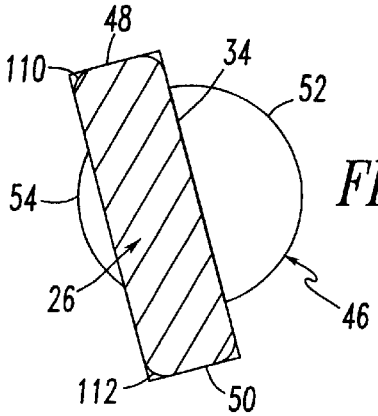
FIG. 7 is a plan view of the opening of FIG. 3, which opening receives and restrains the ends of a cross section of a security lockout device within that opening.

The exemplary scissor lock 28 includes two locking members 107,108 of which both (or at least locking member 107) has the generally rectangular cross section 34. As shown in FIG. 7, the cross section 34 has two opposing ends 110,112. In turn, the opposing portions 48,50 of the perimeter of the opening 46 of FIG. 3 are adapted to restrain the ends 110,112 of the cross section 34, thereby restraining rotation of the cross section 34 within the opening and restraining rotation of the locking member 107 away from the surface 106 of the operating handle 104, in order to maintain and prevent defeat of the lockout operation of the device 20.

Figure 8:
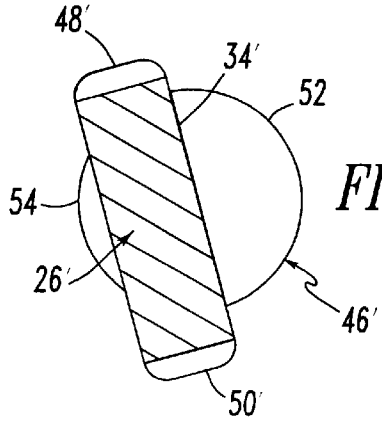
FIG. 8 is a plan view of the opening of another handle locking device in accordance with the invention, which opening receives and restrains the ends of a cross section of a security lockout device within that opening.

FIG. 8 shows an opening 46' for an alternative handle locking device in accordance with the invention. The opening 46' is similar to the opening 46 of FIG. 3 and has a perimeter including a first U-shaped portion 48', and an opposite second U-shaped portion 50', which receive, and restrain from rotation within the opening 46', a rectangular cross section 34' of a shackle 26'. In a like manner as the shackle 26 of the scissor lock 28 of FIG. 6, the shackle 26' is in a plane which blocks movement of the circuit breaker handle from the OFF to the OFF position thereof.

The exemplary handle locking device 20 employs a single opening 46,46' having a perimeter that accepts a padlock shackle 30 through the circular portion of that opening, or alternatively a scissor lock shackle 26,26' through the rectangular (or generally rectangular) portion of that opening. The rectangular (or generally rectangular) portion receives the rectangular (or generally rectangular) cross-section 34,34' of the scissor lock shackle 26,26' and maintains that safety lockout device properly oriented to block movement of the circuit breaker handle to the ON position. By employing a single opening for only one of two different shackles, the profile of the handle locking device flange above the surface of the circuit breaker housing is below the arc of the circuit breaker operator handle, thereby avoiding interference with the inside surface of a door to an electrical distribution panel.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A handle lock device for a movable operator handle of an electrical switching apparatus, said handle lock device operable with a shackle of a safety lockout device and alternatively operable with a shackle of a padlock, the shackle of said safety lockout device having a first cross section, the shackle of said padlock having a different second cross section, said movable operator handle having a first position and a second position, said handle lock device comprising:

a member securable to said electrical switching apparatus;

a flange on said member positionable alongside the movable operator handle of said electrical switching apparatus; and an opening in said flange, said opening receiving only one shackle, said opening having a perimeter which includes first opposing portions receiving the first cross section of the shackle of said safety lockout device and to restrain rotation of said first cross section within said opening, with the shackle of said safety lockout device blocking movement of said movable operator handle from the first position to the second position thereof, said perimeter also includes second opposing portions alternatively receiving the different second cross section of the shackle of said padlock with the shackle of said padlock blocking movement of said movable operator handle from the first position to the second position thereof.

2. The handle lock device of claim 1 wherein said member is, securable to a portion of a ganged multiple pole circuit breaker.

3. The handle lock device of claim 1 wherein said member is securable to a single pole circuit breaker.

4. The handle lock device of claim 1 wherein said safety lockout device is a scissor lock including locking members having the first cross section which is a rectangular cross section having two opposing ends; and wherein the first opposing portions of the perimeter of said opening are restrain the ends of said rectangular cross section.

5. The handle lock device of claim 1 wherein the different second cross section of the shackle of said padlock is a circular cross section; and wherein the second opposing portions of the perimeter of said opening are receiving the circular cross section.

6. The handle lock device of claim 1 wherein said safety lockout device is a scissor lock including locking members having the first cross section which is a rectangular cross section having two opposing ends; wherein the different second cross section of the shackle of said padlock is a circular cross section; wherein the first opposing portions of the perimeter of said opening restrain the ends of said rectangular cross section; and wherein the second opposing portions of the perimeter of said opening are alternatively receiving the circular cross section.

7. The handle lock device of claim 1 wherein the first cross section is a generally rectangular cross section; wherein the different second cross section is a circular cross section; wherein the perimeter of said opening is defined by a first semi-circular portion proximate said movable operator handle, a first U-shaped portion, a second semi-circular portion, which is larger than the first semi-circular portion, and a second U-shaped portion, the first U-shaped portion opposite the second U-shaped portion, and the first semi-circular portion opposite the second larger semi-circular portion; wherein the first and second U-shaped portions restrain the generally rectangular cross section; and wherein the first and second semi-circular portions receive the circular cross section.

8. The handle lock device of claim 7 wherein the shackle of said safety lockout device has a surface; wherein the shackle of said padlock has an edge;

wherein the first and second U-shaped portions restrain the generally rectangular cross section with the surface of the shackle of said safety lockout device in a plane blocking movement of said movable operator handle from the first position to the second position thereof; wherein the first and second semi-circular portions alternatively receive the circular cross section with the edge of the shackle of said padlock offset from said plane toward said movable operator handle and blocking movement of said movable operator handle from the first position to the second position thereof; and wherein said offset is defined by said first semi-circular portion proximate said movable operator handle.

9. The handle lock device of claim 7 wherein the first and second U-shaped portions have rectangular U-shapes.

10. The handle lock device of claim 1 wherein the first position is an OFF position and the second position is an ON position; and wherein said handle lock device blocks movement of said movable operator handle from the OFF position to the ON position.

11. An electrical switching apparatus operable with a shackle of a safety lockout device and alternatively operable with a shackle of a padlock, the shackle of said safety lockout device having a first cross section, the shackle of said padlock having a different second cross section, said electrical switching apparatus comprising:

a housing;

separable contacts;

an operating mechanism having a movable operator handle to open and close said separable contacts, the movable operator handle having a first position and a second position; and a handle lock device comprising:

a member secured to said housing, a flange on said member disposed alongside the movable operator handle of said operating mechanism, an opening in said flange, said opening reciving only one shackle, said opening having a perimeter which includes first opposing portions receiving the first cross section of the shackle of said safety lockout device and to restrain rotation of said first cross section within said opening, with the shackle of said safety lockout device blocking movement of said movable operator handle from the first position to the second position thereof, said perimeter also includes second opposing portions alternatively receiving the different second cross section of the shackle of said padlock with the shackle of said padlock blocking movement of said movable operator handle from the first position to the second position thereof.

12. The electrical switching apparatus of claim 11 wherein said electrical switching apparatus is a ganged multiple pole circuit breaker; and wherein said member is securable to a portion of said ganged multiple pole circuit breaker.

13. The electrical switching apparatus of claim 12 wherein said ganged multiple pole circuit breaker includes a plurality of single pole circuit breakers; wherein said housing has portions for each of said circuit breakers; and wherein said member is secured to one of the portions of said housing.

14. The electrical switching apparatus of claim 11 wherein said electrical switching apparatus is a single pole circuit breaker; and wherein said member is secured to said housing of said single pole circuit breaker.

15. The electrical switching apparatus of claim 11 wherein the different second cross section of the shackle of said padlock is a circular cross section; and wherein the perimeter of said opening has a generally circular portion, which is receiving said circular cross section.

16. The electrical switching apparatus of claim 11 wherein said safety lockout device is a scissor lock including locking members having the first cross section which is a rectangular cross section having two opposing ends; and wherein the first opposing portions of the perimeter of said opening restrain the ends of said rectangular cross section.

17. The electrical switching apparatus of claim 11 wherein the different second cross section of the shackle of said padlock is a circular cross section; and wherein the second opposing portions of the perimeter of said opening are receiving the circular cross section.

18. The electrical switching apparatus of claim 11 wherein said safety lockout device is a scissor lock including locking members having the first cross section which is a rectangular cross section having two opposing ends; wherein the different second cross section of the shackle of said padlock is a circular cross section; wherein the first opposing portions of the perimeter of said opening restrain the ends of said rectangular cross section; and wherein the second opposing portions of the perimeter of said opening are adapted to alternatively receive the circular cross section.

19. The electrical switching apparatus of claim 11 wherein said housing has a surface; wherein said movable operator handle has an operating arc which extends beyond the surface of said housing by a first distance; and wherein the flange of said handle lock device extends beyond the surface of said housing by a second distance which is smaller than said first distance.

20. The electrical switching apparatus of claim 11 wherein said housing includes a window portion; and wherein the member of said handle lock device includes a cut out portion proximate said window portion.

21. The electrical switching apparatus of claim 11 wherein said housing includes a test button; and wherein the member of said handle lock device includes a cut out portion proximate said test button.

22. The electrical switching apparatus of claim 11 wherein said housing includes a face having a surface, and raised portion and a surface on the raised portion; wherein the member of said handle lock device has a surface which abuts the surface of the face of said housing, and further has a pair of teeth which engage said raised portion; and wherein the flange of said handle lock device includes an L-shaped portion which abuts the raised portion and the surface of the face of said housing.

23. The electrical switching apparatus of claim 11 wherein the first position is an OFF position and the second position is an ON position; and wherein said handle lock device blocks movement of said movable operator handle from the OFF position to the ON position.

24. The electrical switching apparatus of claim 11 wherein the movable operator handle has a surface which is disposed at an angle with respect to said member secured to said housing in the first position of said operator handle; and wherein the first opposing portions of the opening are disposed at said angle with respect to said member.

* * * * *